US007703307B2

(12) United States Patent
Kim et al.

(10) Patent No.: US 7,703,307 B2
(45) Date of Patent: Apr. 27, 2010

(54) DRIVING UNIT FOR WASHING MACHINE AND METHOD FOR CONTROLLING THE SAME

(75) Inventors: Dong Won Kim, Gwangmyeong-si (KR); Ki Chul Woo, Seoul (KR)

(73) Assignee: LG Electronics Inc., Seoul (KR)

( * ) Notice: Subject to any disclaimer, the term of this patent is extended or adjusted under 35 U.S.C. 154(b) by 1115 days.

(21) Appl. No.: 11/180,560

(22) Filed: Jul. 14, 2005

(65) Prior Publication Data

US 2006/0010612 A1 Jan. 19, 2006

(30) Foreign Application Priority Data

Jul. 16, 2004 (KR) ..... 10-2004-0055444
Jul. 16, 2004 (KR) ..... 10-2004-0055445

(51) Int. Cl.
*D06F 37/40* (2006.01)

(52) U.S. Cl. ..... 68/133; 68/140

(58) Field of Classification Search ..... 134/184, 134/198; 68/133, 140
See application file for complete search history.

(56) References Cited

U.S. PATENT DOCUMENTS 2,161,604 A * 6/1939 Watts ..... 68/12.02
2,399,319 A * 4/1946 Bowen et al. ..... 475/318
3,257,830 A * 6/1966 Shelton ..... 68/133
3,306,133 A * 2/1967 Hans et al. ..... 475/149
4,317,343 A * 3/1982 Gerry ..... 68/23.7
4,890,465 A * 1/1990 Burk et al. ..... 68/23.7
4,910,979 A * 3/1990 Burk et al. ..... 68/23.7
5,187,954 A * 2/1993 Kim et al. ..... 68/3 R
5,379,616 A * 1/1995 Bae ..... 68/23.7
5,950,459 A * 9/1999 Takagi et al. ..... 68/23.6
7,441,422 B2 * 10/2008 Choi ..... 68/58
2004/0163429 A1 * 8/2004 Lim ..... 68/140

(Continued)

FOREIGN PATENT DOCUMENTS

CN 1211651 A 3/1999

(Continued)

OTHER PUBLICATIONS

European Patent Office 0 377 496 Jul. 1990.*

(Continued)

*Primary Examiner*—Frankie L Stinson
(74) *Attorney, Agent, or Firm*—McKenna Long & Aldridge LLP

(57) ABSTRACT

A driving unit for a washing machine, and method for controlling the same. The driving unit includes a bearing housing fixedly secured to an outer tub. A motor is mounted on the bearing housing. A ring gear shaft is rotatably mounted to the bearing housing and is coupled to an inner tub. A carrier shaft is rotatably mounted in the ring gear shaft, with a driving shaft rotatably mounted in the carrier shaft. The driving shaft is coupled to the motor. A reduction gear is positioned between the ring gear shaft and the carrier shaft to reduce a speed of the ring gear shaft. A one directional holding device that holds the carrier shaft when the driving shaft rotates in a first direction, and holds two of the carrier shaft, the ring gear shaft, and the driving shaft when the driving shaft rotates in a second direction.

7 Claims, 18 Drawing Sheets

U.S. PATENT DOCUMENTS

| | | | |
|---|---|---|---|
| 2004/0168485 | A1 | 9/2004 | Lim |
| 2005/0076456 | A1 | 4/2005 | Lee et al. |

FOREIGN PATENT DOCUMENTS

| | | | |
|---|---|---|---|
| EP | 1433892 | | 6/2004 |
| FR | 1285219 | | 2/1962 |
| JP | 06-261997 | * | 9/1984 |
| JP | 60-249997 | * | 12/1985 |
| JP | 62-180155 | * | 8/1987 |
| JP | 64-049599 | * | 2/1989 |
| KR | 10-1999-0041017 | | 12/1999 |
| KR | 10-1999-0084877 | | 12/1999 |
| KR | 2001079351 | * | 8/2001 |
| KR | 2001079463 | * | 8/2001 |

OTHER PUBLICATIONS

English language abstract of FR 1285219.
English language Abstract of JP 11-070293 A.

* cited by examiner

DRIVING UNIT FOR WASHING MACHINE AND METHOD FOR CONTROLLING THE SAME

CROSS-REFERENCE TO RELATED APPLICATIONS

This application claims the benefit of Korean Application Nos. 10-2004-0055444 and 10-2004-0055445, both filed on Jul. 16, 2004, which are hereby incorporated by reference in their entireties.

BACKGROUND OF THE INVENTION

1. Field of the Invention

The present invention relates to washing machines, and more particularly, to a washing machine which enables simplification of a structure of a driving unit and which provides an adequate driving torque even if a small sized motor is utilized therein, and a method for controlling the same.

2. Discussion of the Related Art

In general, washing machines wash laundry by action of circulation of washing water, and a chemical action, such as detergent, and the like.

In the washing machines, there are top load type washing machines, and front load type washing machines. In the top load type washing machines, there are tub rotating type machines, and pulsator type washing machines, and in the front load type washing machines, there are drum type washing machines.

For washing and spinning, a driving unit is provided to the washing machine. The driving unit generally has an induction motor applied thereto.

The induction motor does not have a brush and commutator, and no magnets are provided to a rotor thereof. The induction motor has no burning of the brush and the commutator, and no demagnetization of the magnets, accordingly. The induction motor generates a rotation force by interaction of a rotating magnetic field generated by a current flowing through a line wound on a stator and a current induced at the rotor.

The induction motor is coupled to a washing shaft, and the washing shaft is coupled to a reduction gear unit. The washing shaft has a clutch coupled thereto for increasing/decreasing a speed of an inner tub by using a reduction gear unit.

The drum type washing machine washes laundry at a low rotation speed of the inner tub by the reduction gear in a washing cycle, and extracts water from the laundry as the inner tub spins at a higher rotation speed in a spinning cycle.

However, conventional driving units of the washing machine have several problems.

First, if the driving unit has the induction motor applied thereto, even though a unit cost of the motor can be lowered, there has been a problem in that a structure of the driving unit becomes complicated because a clutch and a speed reduction device are required additionally for regulating a rotation speed of the motor.

Second, since the driving unit moves together with devices, such as clutch, mechanical, and electrical noise increases.

Third, because a torque on the inner tub increases in proportion to the speed reduction by the reduction gear in the washing cycle, the washing cycle can be started, directly. Opposite to this, at an initial stage of spinning, there is shortage of the torque on the inner tub as the torque is not increased by the speed reduction of the reduction gear. Particularly, in a case of small sized motor, such a problem is distinctive.

Fourth, for starting the spinning cycle, the inner tub is rotated in regular/reverse directions to distribute the laundry evenly, and, then, the torque is increased to a certain level to start a spinning mode. However, this method prolongs a spinning time period due to the longer starting time period, and increases power consumption.

Fifth, the regular/reverse direction rotation of the inner tub for starting the spinning causes heavy mechanical and electrical noise.

SUMMARY OF THE INVENTION

Accordingly, the present invention is directed to a washing machine, and a method for controlling the same that substantially obviates one or more above-noted problems.

An object of the present invention is to provide a washing machine, and a method for controlling the same, which enables to simplify a structure of a driving unit and to obtain an adequate torque even if a small sized motor is applied thereto.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a driving unit for a washing machine includes a bearing housing fixedly secured to an outer tub of the washing machine, a motor mounted on the bearing housing, a ring gear shaft rotatably mounted to the bearing housing, the ring gear shaft being coupled to an inner tub of the washing machine, a carrier shaft rotatably mounted to the ring gear shaft, a driving shaft rotatably mounted to the carrier shaft, the driving shaft being coupled to the motor, a reduction gear positioned between the ring gear shaft and the carrier shaft to reduce a rotation speed of the ring gear shaft, and a one directional holding device that holds the carrier shaft when the driving shaft rotates in a first direction, and holding two of the carrier shaft, the ring gear shaft, and the driving shaft when the driving shaft rotates in a second direction.

In one embodiment, the one directional holding device includes a first one way bearing between the bearing housing and the carrier shaft that holds the carrier shaft to the bearing housing only when the driving shaft is rotated in the first direction, and a second one way bearing between the ring gear shaft and the carrier shaft that holds the ring gear shaft and the carrier shaft only when the driving shaft is rotated in the second direction. The driving unit may include supporting bearings mounted on an outside circumferential surface of the ring gear shaft to bi-directionally rotate the ring gear shaft, and a supporting bearing between the carrier shaft and the driving shaft that supports and bi-directionally rotates the driving shaft.

Alternatively, the one directional holding device may include a first one way bearing between the bearing housing and the carrier shaft to hold the carrier shaft to the bearing housing only when the driving shaft is rotated in the first direction, and a second one way bearing between the carrier shaft and the driving shaft that holds the carrier shaft and the driving shaft only when the driving shaft is rotated in the second direction. The driving unit may include supporting bearings mounted on an outside circumferential surface of the ring gear shaft to bi-directionally rotate the ring gear shaft, and supporting bearings between the ring gear shaft, the carrier shaft and the driving shaft that support and bi-directionally rotate the driving shaft.

Alternatively, the one directional holding device may include a first one way bearing between the bearing housing and the carrier shaft that holds the carrier shaft to the bearing housing only when the driving shaft is rotated in the first direction, and a second one way bearing between the ring gear shaft and the driving shaft to hold the ring gear shaft and the driving shaft only when the driving shaft is rotated in the second direction. The driving shaft may have an end portion placed in the ring gear shaft, and the second one way bearing may be mounted between an end and the ring gear shaft.

The driving unit may include supporting bearings mounted on an outside circumferential surface of the ring gear shaft to bi-directionally rotate the ring gear shaft, and supporting bearings between the ring gear shaft, the carrier shaft and the driving shaft to support and bi-directionally rotate the ring gear shaft, the carrier shaft, and the driving shaft.

The reduction gear may include a sun gear formed on an outside circumferential surface of the driving shaft, planet gears mounted to engage with, and revolve around the sun gear as well as rotate around their own axes, and an internal gear formed on an inside circumferential surface of the ring gear shaft to engage with the planet gears.

In another aspect of the present invention, a method for controlling a washing machine in a spinning cycle includes rotating an inner tub at a first speed by rotating a rotor in a direction opposite to a rotation direction of the inner tub, rotating the inner tub at a second speed, higher than the first speed, by reversing a rotation direction of the rotor, thereby rotating the rotor in the rotation direction of the inner tub, and rotating the rotor at a spinning speed to extract water from laundry placed in the washing machine.

The method may also include reversing the rotation direction of the rotor when the inner tub reaches a predetermined rotation speed. Rotating the inner tub at the first speed may include rotating the inner tub at a speed which enables the inner tub to distribute laundry uniformly. Rotating the inner tub at the first speed may also include rotating the inner tub at a speed of approximately 80~200 rpm.

The method may also include stopping the rotor before reversing its rotation direction.

Rotating the rotor at a spinning speed may include rotating the inner tub at a predetermined speed and accelerating the rotation speed of the inner tub to the spinning speed.

The predetermined speed may uniformly distributes the laundry.

The method may also include reaching the predetermined speed by accelerating the inner tub in predetermined stages. Accelerating the rotation speed of the inner tub may include accelerating the inner tub to approximately 50-60 rpm, and then accelerating the inner tub to approximately 80-200 rpm.

In another aspect of the present invention, a method for controlling a washing machine includes performing a washing cycle, in which an inner tub is rotated at a first speed by rotating a rotor, performing a rinsing cycle, in which the inner tub is rotated at the first speed by rotating the rotor, and performing a spinning cycle, after the washing and rinsing cycles have finished and washing water is drained. Performing the spinning cycle includes rotating an inner tub at a second speed by rotating a rotor in a direction opposite to a rotation direction of the inner tub, rotating the inner tub at a third speed, higher than the second speed, by reversing a rotation direction of the rotor, thereby rotating the rotor in the rotation direction of the inner tub, and rotating the rotor at a spinning speed to extract water from laundry placed in the washing machine. The method may also include reversing the rotation direction of the rotor when the inner tub reaches a predetermined rotation speed.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention, in which reference characters refer to the same parts throughout the various views. The drawings are not necessarily to scale, emphasis instead being placed upon illustrating the principles of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

A driving unit of a washing machine of the present invention will be described with reference to the attached drawings.

Figure 1:
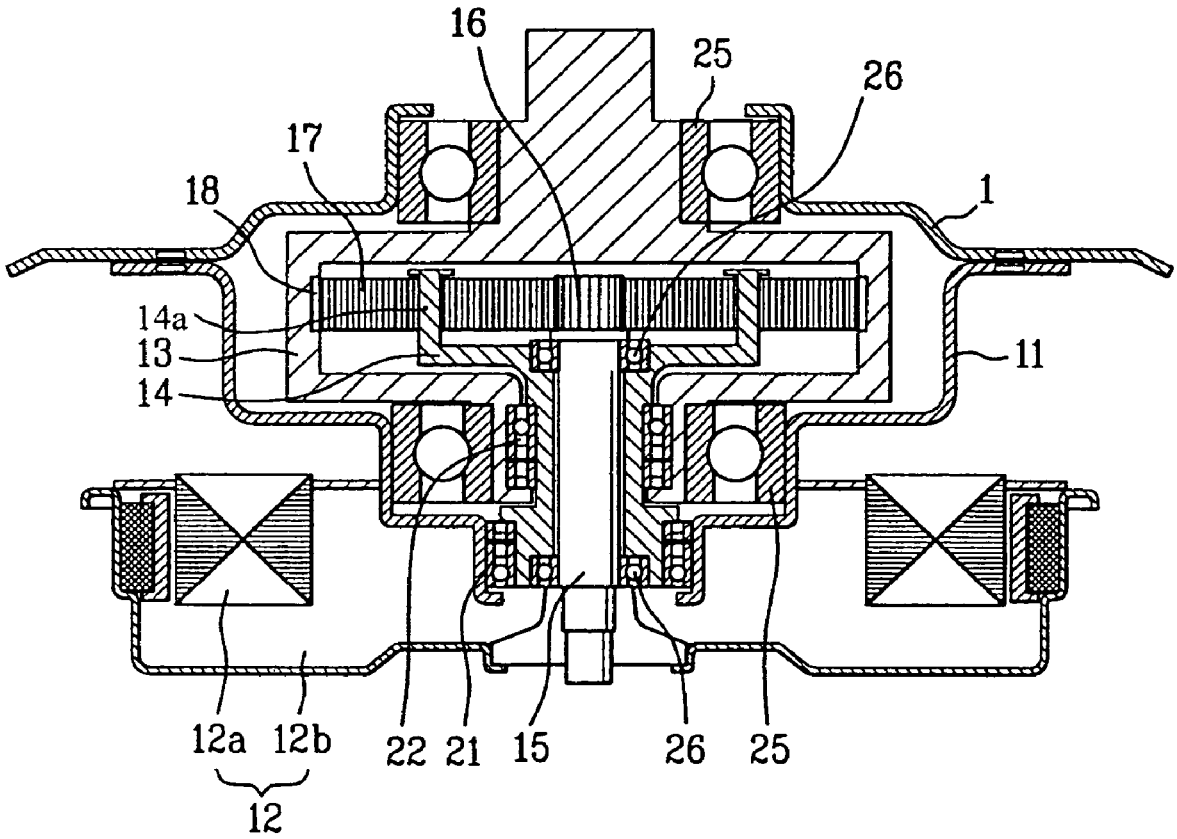
FIG. 1 illustrates a diagram of a driving unit of a washing machine in accordance with a preferred embodiment of the present invention.

Referring to FIG. 1, the driving unit of the washing machine includes a bearing housing 11, a motor 12, a ring gear shaft 13, a carrier shaft 14, a driving shaft 15, reduction gears 16, 17, and 18, and a one directional holding devices 21, and 22.

The bearing housing 11 is fixedly secured to an outer tub, and the outer tub 1 has an inner tub rotatably mounted therein. The bearing housing is fastened to the outer tub with fastening members, such as bolts.

The bearing housing 11 has a reversible motor 12 mounted on an underside thereof. As shown in FIG. 1, the motor 12 is an outer rotor type motor having a rotor 12*b* rotated on an outer side of the stator 12*a*. Moreover, though not shown, the motor 12 may be an inner rotor type motor having a rotor rotated on an inner side of the stator.

The motor is suggested to be an induction motor or a brushless motor.

The bearing housing 11 has a ring gear shaft 13 rotatably mounted therein. The ring gear shaft 13 is passed through the outer tub 1 and coupled to the inner tub (not shown), for transmission of a driving power to the inner tub.

The ring gear shaft 13 has a middle portion expanded outwardly, with reduction gears and so on mounted on an inner side thereof.

The ring gear shaft 13 has a carrier shaft 14 rotatably mounted on an inner side thereof, and the carrier shaft 14 has a driving shaft 15 rotatably mounted on an inner side thereof. The driving shaft 15 is coupled to the rotor 12*b*, and the reduction gears.

If the motor 12 is of an outer rotor type, as shown in FIG. 1, the driving shaft 15 is coupled to the outer rotor 12*b*. If the motor 12 is of an inner rotor type 12, the driving shaft 15 is coupled to the inner rotor.

The reduction gear is mounted between the ring gear shaft 13 and the carrier shaft 14 for reducing a speed of the ring gear shaft 13.

The reduction gear includes a sun gear 16 formed on an outside circumferential surface of the driving shaft 15, planet gears mounted to revolve around the sun gear 16 as well as rotate around their own axes, and an internal gear 18 formed on an inside circumferential surface of the ring gear shaft 13 so as to engage with the planet gears.

Planet gear 17 is rotatably mounted on a shaft portion 14*a* projected upward from a top of the carrier shaft 14. According to this, the planet gear 17 moves with the carrier shaft 14, to revolve around the sun gear 16, and rotates around the shaft portion 14*a*.

It is required that gear ratios of the sun gear 16, the planet gear 17, and the internal gear 18 are designed properly taking a reduction ratio of the ring gear shaft 13.

In the meantime, the one directional holding device is mounted such that the one directional holding device holds the carrier shaft 14 when the driving shaft 15 rotates in one direction, and two of the carrier shaft 14, the ring gear shaft 13, and the driving shaft 15 when the driving shaft 15 rotates in the other direction.

A first embodiment of the one directional holding device will be described.

Referring to FIG. 1, the first embodiment of the one directional holding device includes a first one way bearing 21 between the bearing housing 11 and the carrier shaft 14 for making the carrier shaft to be held at the bearing housing 11 only when the driving shaft 15 is rotated in one direction, and a second one way bearing 22 between the ring gear shaft 13 and the carrier shaft 14 for holding the ring gear shaft 13 and the carrier shaft only when the driving shaft 15 is rotated in the other direction.

Figure 2A:
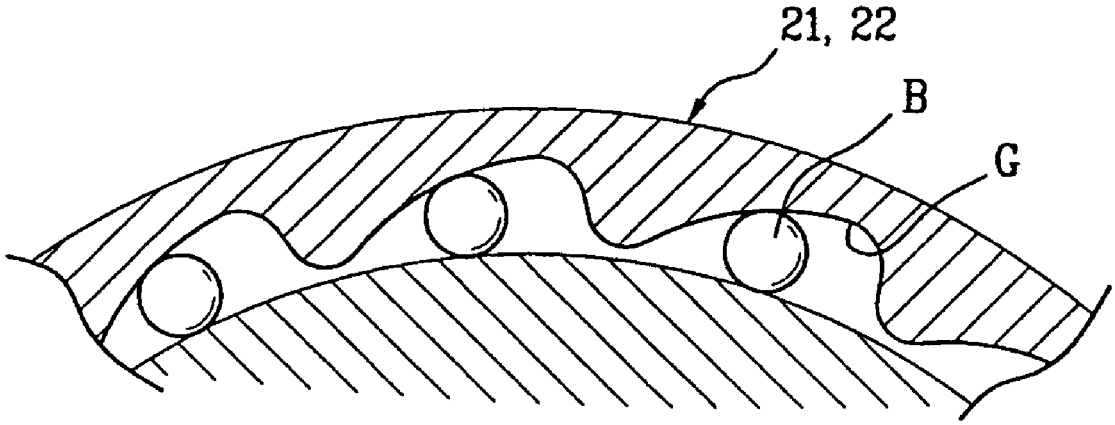
FIG. 2A illustrates a section of a first embodiment of the one directional holding device illustrated in FIG. 1 in a held state.
Figure 2B:
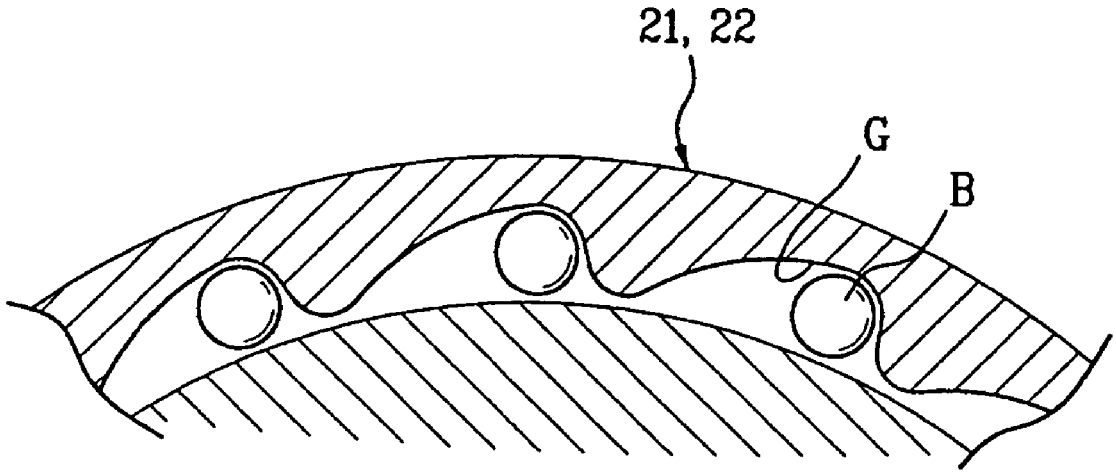
FIG. 2B illustrates a section of the first embodiment of the one directional holding device in FIG. 1 in a released state.

Referring to FIGS. 2A and 2B, the first, and second one way bearings 21, and 22 each has a plurality of grooves G along an inside circumferential surface of a bearing race, in each of which a ball B is rotatably placed. The groove has one side with a large curvature, and the other side with a small curvature.

Therefore, as shown in FIG. 2A, if a shaft rotates in one direction, the ball B moves in a direction of the large curvature, to hold the shaft. On the other hand, as shown in FIG. 2B, if the shaft rotates in the other direction, the ball B moves in a direction of the small curvature, to release the shaft.

On outside circumferential surfaces of the ring gear shaft 13, there are supporting bearings 25 mounted thereon for bidirectional rotation of the ring gear shaft 13. The supporting bearings 25 are mounted between the ring gear shaft, and the outer tub or the bearing housing.

In addition to this, between the carrier shaft 14 and the driving shaft 15, there is a supporting bearing 26 for supporting, and bidirectional rotation of, the driving shaft 15.

The operation of the driving unit having the first embodiment of the one directional holding device applied thereto will be described.

Figure 3A:
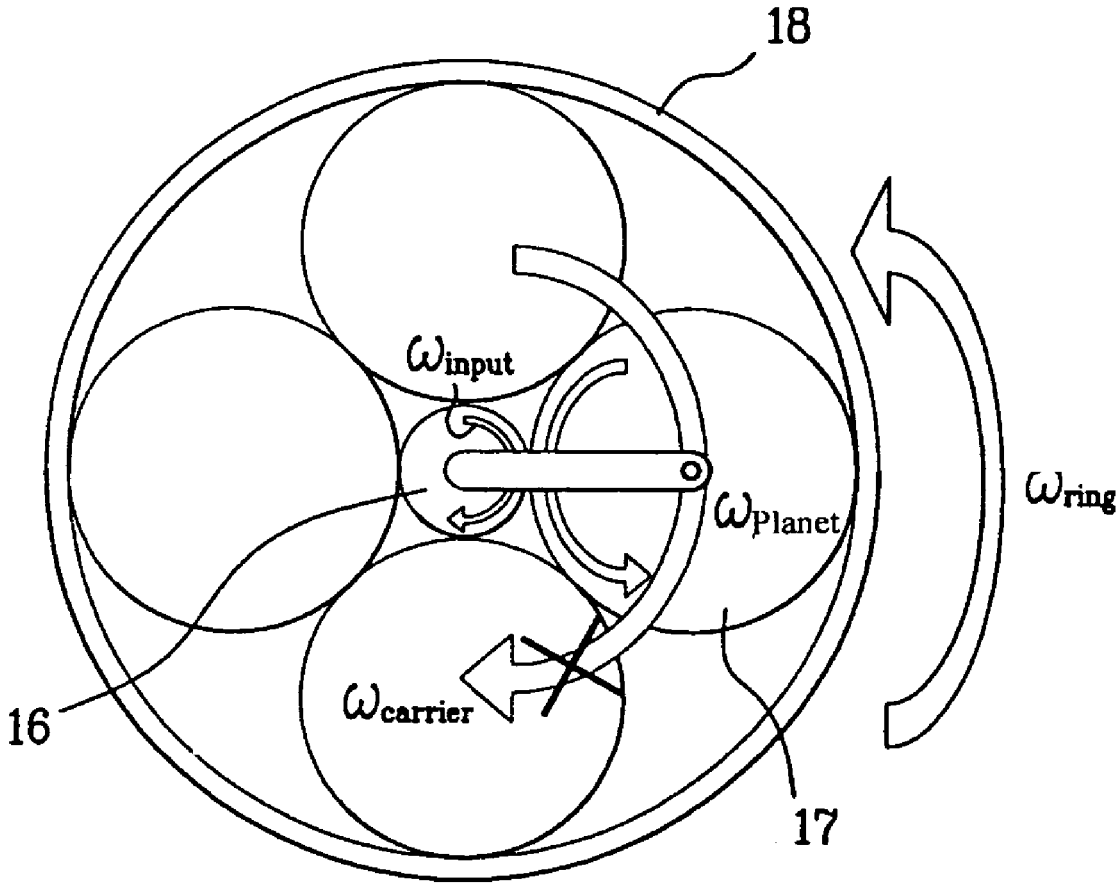
FIGS. 3A, and 3B illustrate diagrams of operation states of a driving unit when the washing machine in FIG. 1 is operated in a washing mode.
Figure 3B:
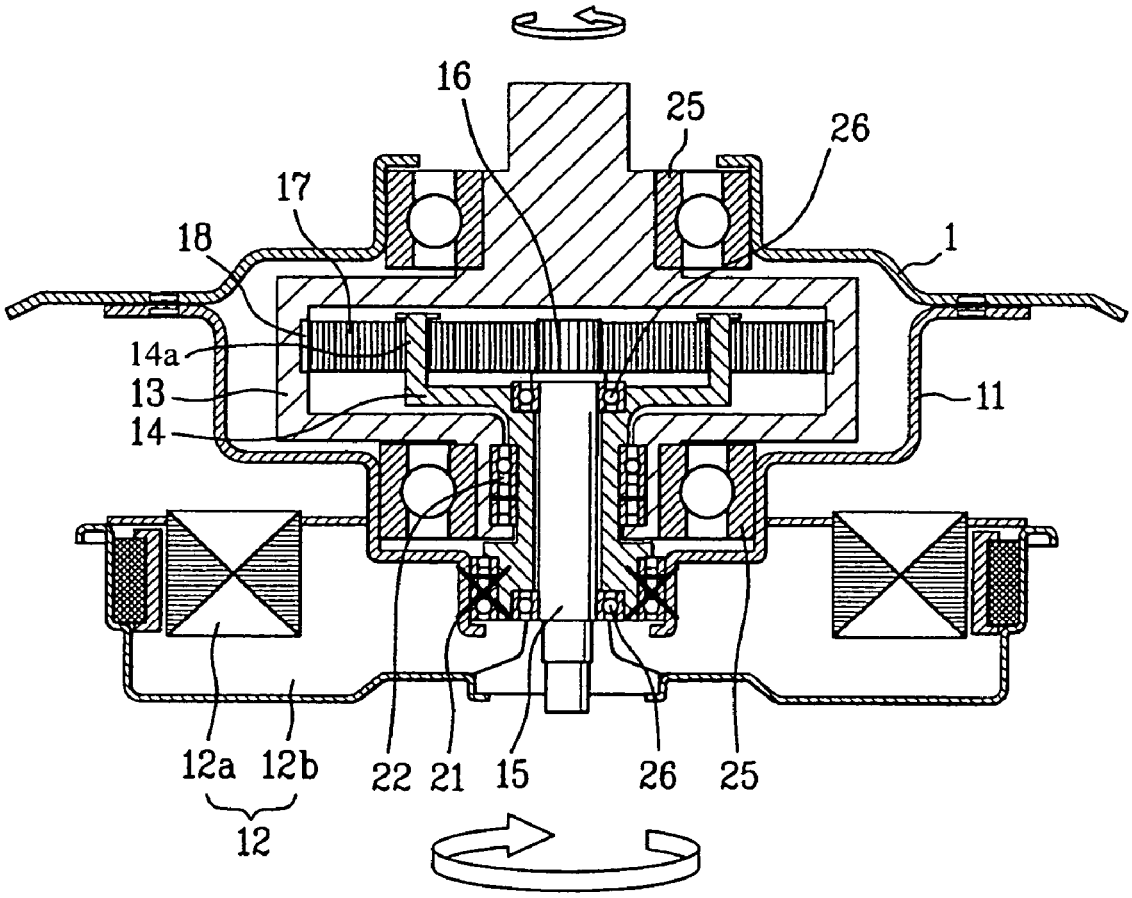

Referring to FIGS. 3A and 3B, the operation of the driving unit will be described when the washing machine is in a washing mode. In FIG. 3A, "X" denotes a shaft that does not rotate, and, in FIG. 3B, "X" denotes that the one way bearing 21 does not rotate.

When power is applied to the motor 12 following starting of the washing cycle, a driving force is generated by action of the stator 12*a* and the rotor 12*b*.

If the driving unit has the induction motor applied thereto, the driving force is generated by interaction of a rotating magnetic field formed by a current in a winding of the stator and an induction current generated in a core of the rotor. If the driving unit has the brushless motor applied thereto, the driving force is generated by an electromagnetic force generated at the winding of the stator and magnets of the rotor.

Referring to FIG. 3A, as the rotor 12*b* rotates in one direction, the driving shaft 15 rotates in one direction (a clockwise direction) ($\omega_{input}$).

In this instance, the carrier shaft 14 is held at the bearing housing 11 by the first one way bearing 21. That is, as shown in FIG. 2A, as balls B in the first one way bearing 21 move toward the large curvatures, the carrier shaft 14 is held unable to rotate.

In the meantime, since the second one way bearing 22 is mounted such that a holding direction of the second one way bearing 22 is opposite to the holding direction of the first one way bearing 21, the ring gear shaft 13 is not held at the carrier shaft 14. That is, as shown in FIG. 2B, as balls B of the second one way bearing 22 move toward the small curvatures of the grooves, the ring gear shaft 13 is enabled to rotate.

Under this state, the planet gears 17 engaged with the sun gear 16 rotate in a direction (counter-clockwise direction) opposite to a rotation direction of the driving shaft 16 ($\omega_{planet}$). In this instance, since the carrier shaft 14 is held at the bearing housing 11 by the first one way bearing 21, the planet gears make no revolution around the sun gear 16, but only rotate around its axes.

Since the planet gears have the internal gear 18 on the ring gear shaft 13 engaged therewith, the ring gear shaft 13 rotates in a direction (counter-clockwise direction) the same with a rotation direction of the planet gears 17 ($\omega_{ring}$). That is, as shown in FIGS. 3A and 3B, the rotation direction ($\omega_{input}$) of the motor 12 and the driving shaft 16 are opposite to the rotation direction of the ring gear shaft 13 ($\omega_{ring}$).

A rotation speed of the ring gear shaft 13 is reduced according to gear ratios of the sun gear 16, and the planet gear 17, and the internal gear 18, and, according to this, a speed of the inner tub connected to an end of the ring gear shaft 13 is reduced, proportionally. ($\omega_{input}>\omega_{ring}$).

Since the slow speed rotation of the inner tub in the washing cycle makes the torque higher relatively, to make formation of circulation of washing water easy, the washing performance is improved.

Meanwhile, since operation of the driving unit in a rinsing cycle is identical to the washing cycle, the description of the rinsing cycle will be omitted.

Once the washing cycle or the rinsing cycle is finished, and the washing water is drained, a spinning cycle is performed. The spinning cycle will be described.

Figure 4A:
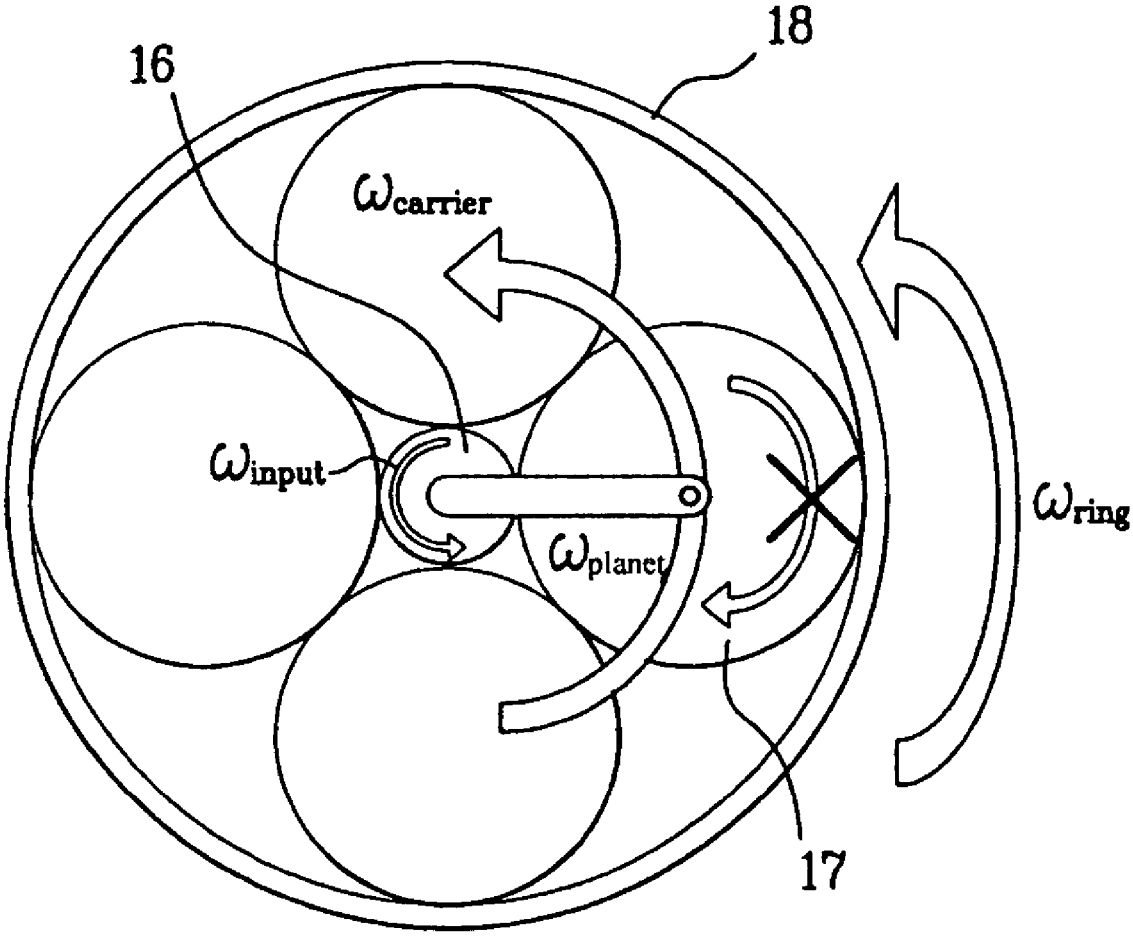
FIGS. 4A, and 4B illustrate diagrams of operation states of a driving unit when the washing machine of FIG. 1 is operated in a spinning mode.
Figure 4B:
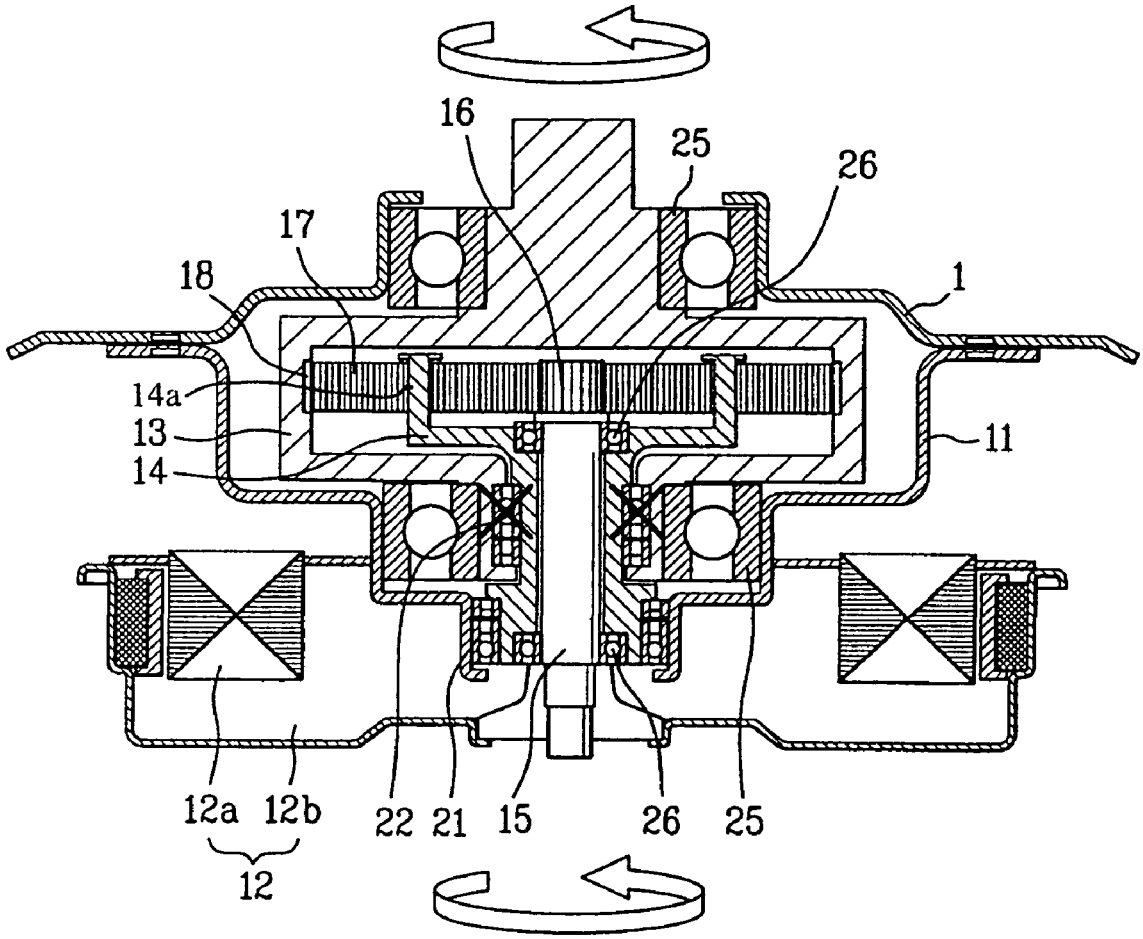

Referring to FIGS. 4A and 4B, the operation of the driving unit will be described when the washing machine is operated in the spinning mode. In FIG. 4A, "X" denotes that the shaft does not rotate, and, in FIG. 4B, "X" denotes that the one way bearing does not rotate.

Upon application of power to the motor 12 following starting of the spinning cycle, a driving force is generated by actions of the stator 12*a* and the rotor 12*b*.

Referring to FIG. 4A, as the rotor 12*b* rotates in the counter-clockwise direction, the driving shaft 15 rotates in the counter-clockwise direction ($\omega_{input}$).

In this instance, the carrier shaft 14 is released from the bearing housing 11 by the first one way bearing 21. That is, as shown in FIG. 2B, as balls B of the first one way bearing 21 move toward the small curvatures of the grooves G, the carrier shaft 14 is enabled to rotate ($\omega_{carrier}$).

At the same time, since the second one way bearing 22 is mounted such that the holding direction of the second one way bearing 22 is opposite to the holding direction of the first one way bearing 21, the second one way bearing holds the ring gear shaft 13 and the carrier shaft 14. That is, as balls B of the second one way bearing move toward the large curvatures of the grooves G, the ring gear shaft 13 and the carrier shaft 14 are held unable to rotate, relatively.

In this instance, since the sun gear 16 and the planet gears 17 make no relative rotation, the planet gears 17 do not rotate ($\omega_{planet}$). In this instance, the planet gears 17 only revolve around the sun gear 16 ($\omega_{carrier}$).

According to this, as shown in FIG. 4B, the ring gear shaft 13 rotates at the same speed, and in the same direction (i.e., counter-clockwise direction) with the driving shaft 15 ($\omega_{input}=\omega_{ring}$).

Thus, in the spinning cycle, as the inner tub spins, the laundry in the inner tub has water extracted by centrifugal force.

In the foregoing first embodiment, the rotation direction of the inner tub is always the same regardless of rotation direction of the rotor i.e., in a regular direction or a reverse direction, and when the rotor is rotated in one direction, the rotation speed of the inner tub is reduced by the reduction gear.

A second embodiment of a driving unit of the washing machine will now be described. The second embodiment has the one directional holding means of which position is changed from the one directional holding means of the first embodiment. Therefore, only the feature of the second embodiment will be described, and the same reference symbols will be used for the same parts.

Figure 5:
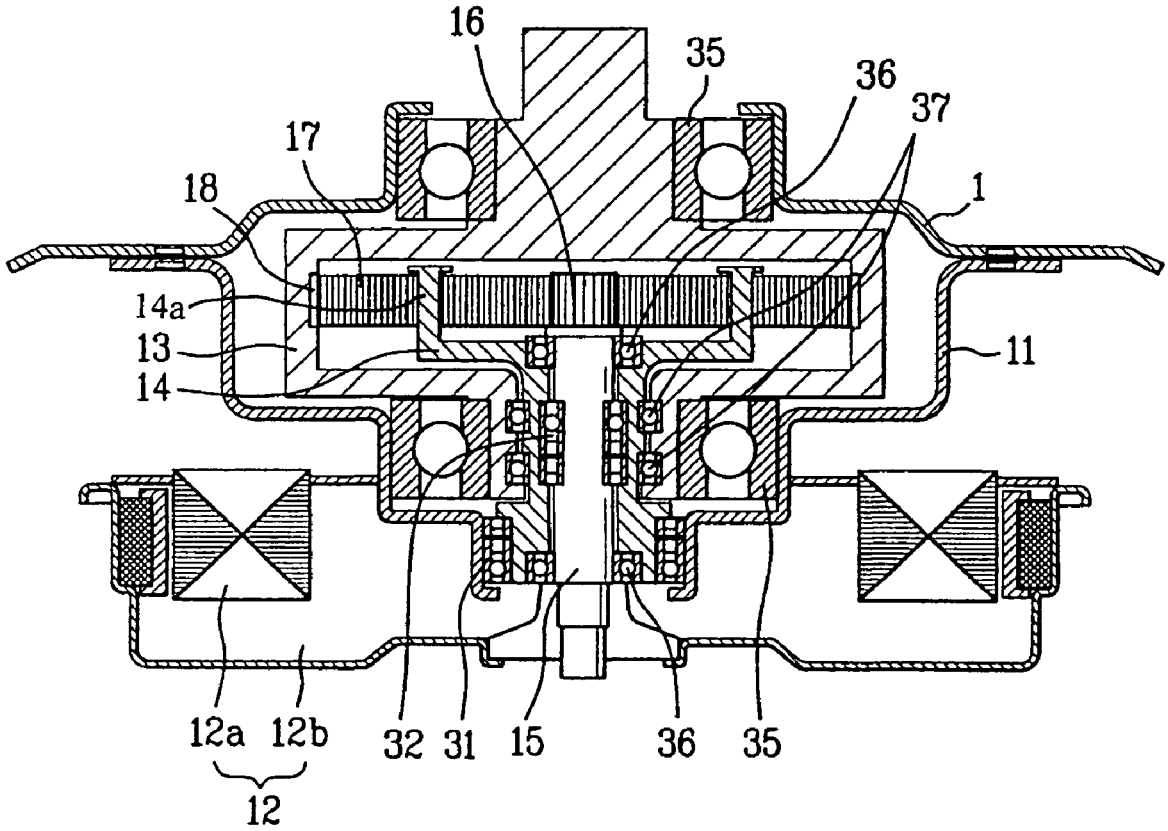
FIG. 5 illustrates a diagram of a second embodiment of the one directional holding device of the driving unit in FIG. 1.
Figure 6A:
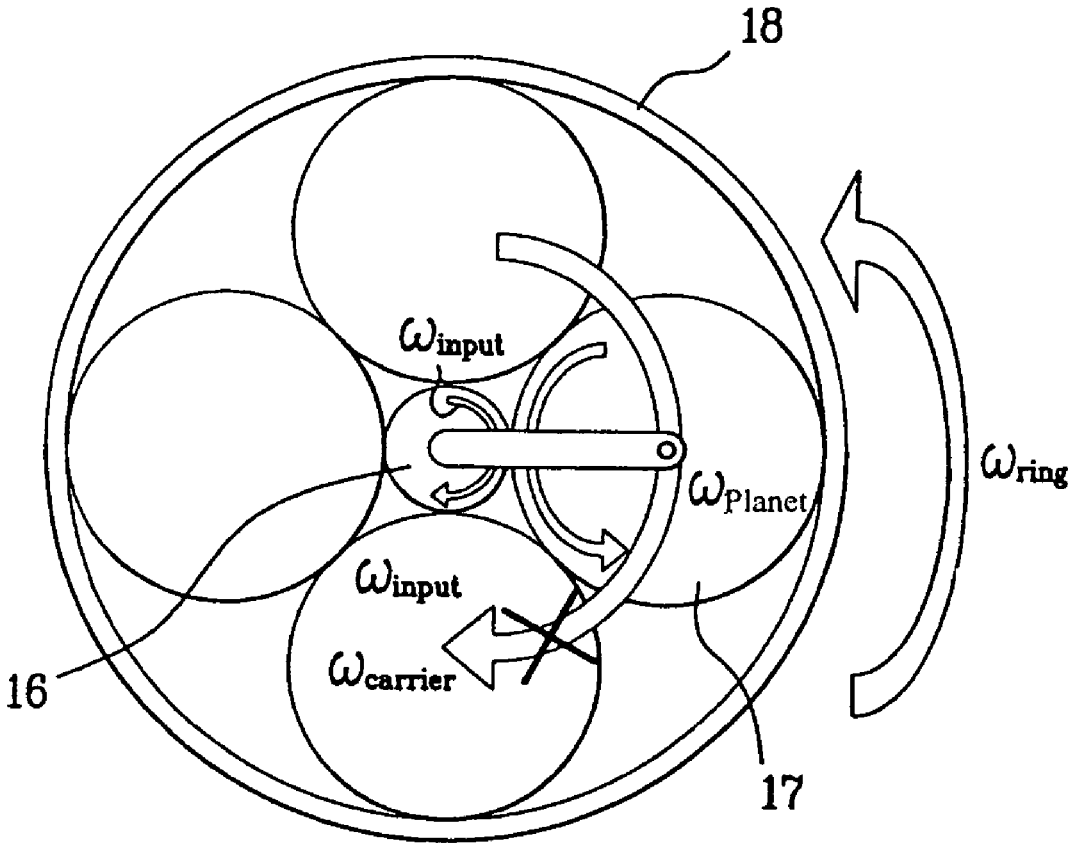
FIGS. 6A, and 6B illustrate diagrams of operation states of a driving unit when the washing machine in FIG. 5 is operated in a washing mode.
Figure 6B:
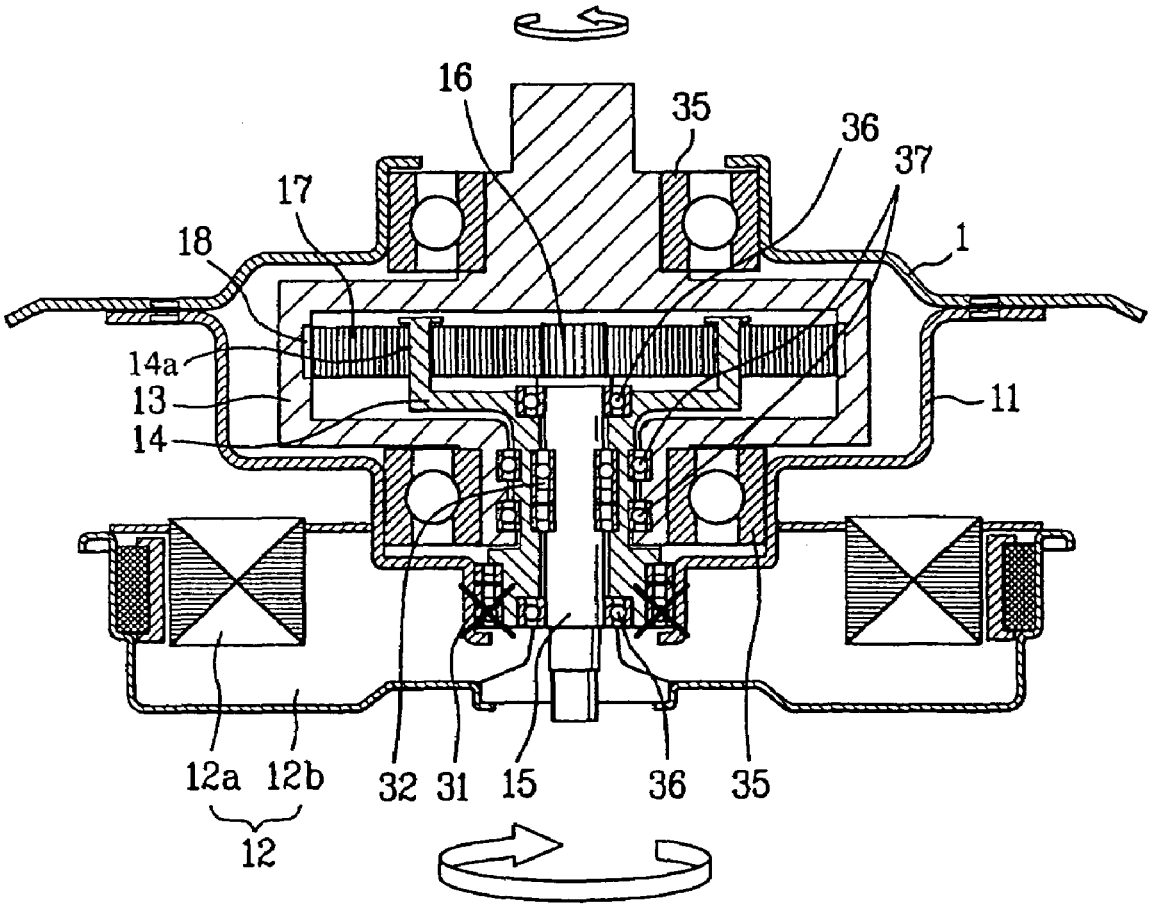
Figure 7A:
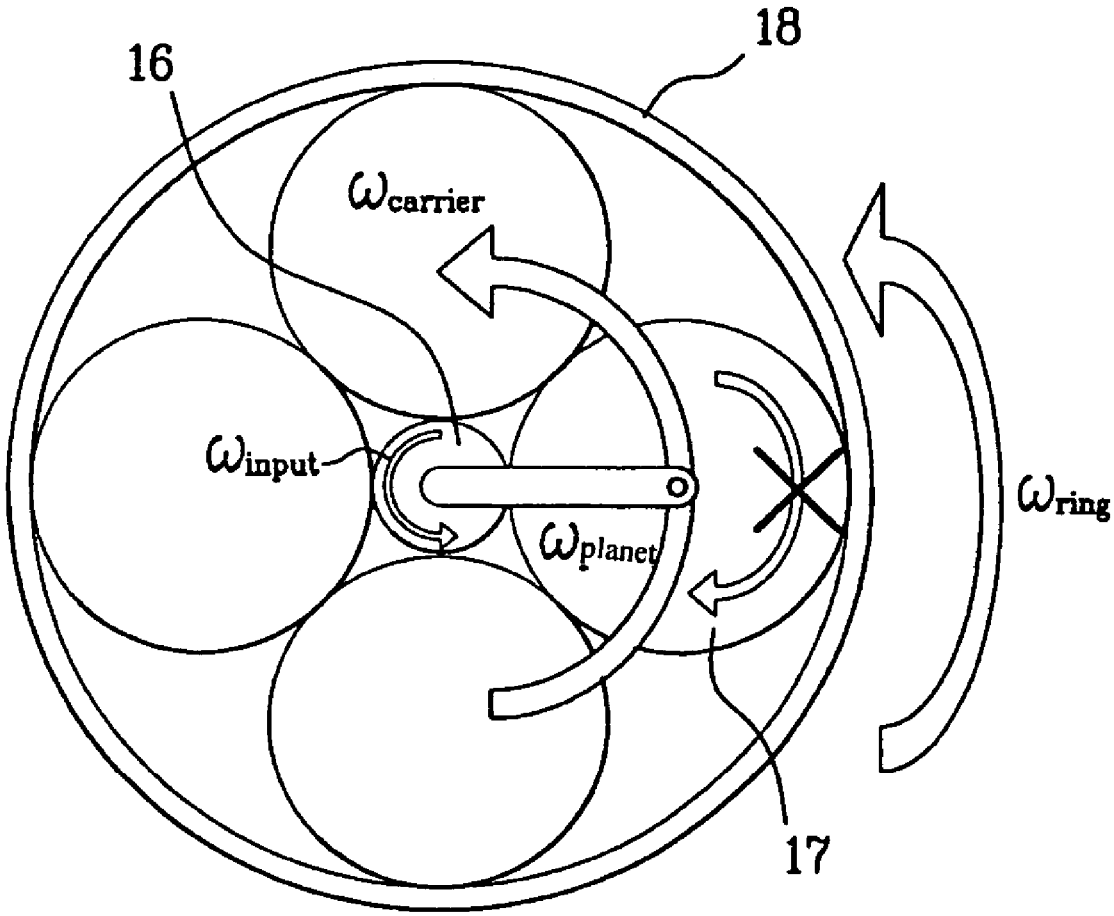
FIGS. 7A, and 7B illustrate diagrams of operation states of a driving unit when the washing machine of FIG. 5 is operated in a spinning mode.
Figure 7B:
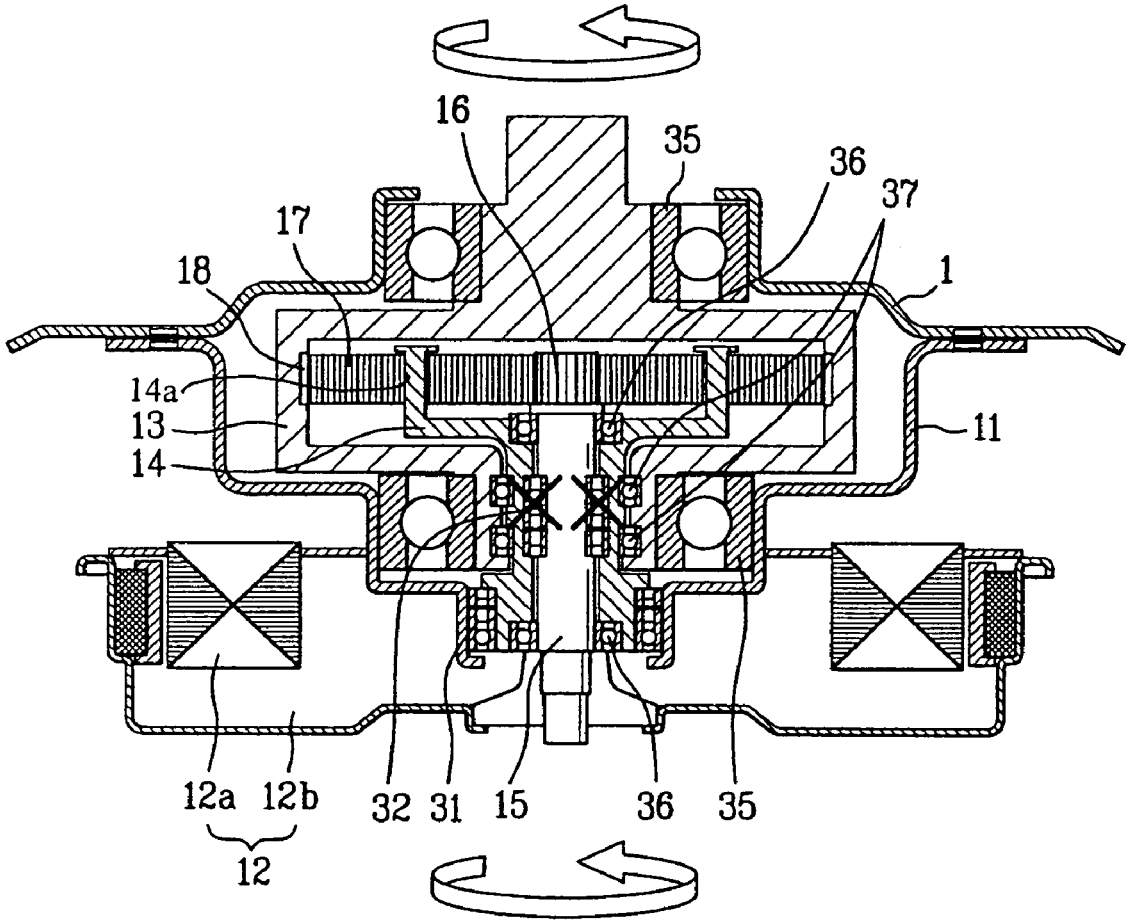

FIG. 5 illustrates a diagram of a second embodiment of the one directional holding device of the driving unit in FIG. 1. FIGS. 6A, and 6B illustrate diagrams of operation states of a driving unit when the washing machine in FIG. 5 is operated in a washing mode. FIGS. 7A, and 7B illustrate diagrams of operation states of a driving unit when the washing machine in FIG. 5 is operated in a spinning mode.

Referring to FIG. 5, the one directional holding device includes a first one way bearing 31 between the bearing housing 11 and the carrier shaft 14 for making the carrier shaft 14 to be held at the bearing housing 11 only when the driving shaft 15 is rotated in one direction, and a second one way bearing 32 between the carrier shaft 14 and the driving shaft 15 for holding the carrier shaft 14 and the driving shaft 15 only when the driving shaft 15 is rotated in the other direction.

On outside circumferential surfaces of the ring gear shaft 13, there are supporting bearings 35 mounted thereon for bidirectional rotation of the ring gear shaft 13. In addition to this, between the ring gear shaft 13 and the carrier shaft 14, there is a supporting bearing 36 for supporting, and bidirectional rotation of, the carrier shaft 14. Also, there is a supporting bearing between the carrier shaft 14 and the driving shaft 15.

The operation of the driving unit having the second embodiment of the one directional holding device applied thereto will be described. At first, referring to FIGS. 6A and 6B, the operation of the driving unit will be described when the washing machine is in a washing mode.

Referring to FIG. 6A, when power is applied to the motor 12 following starting of the washing cycle, the driving shaft 15 is rotated in one direction (e.g., a clockwise direction) ($\omega_{input}$), following rotation of the stator 12*a* in one direction.

In this instance, the carrier shaft 14 is held at the bearing housing 11 by the first one way bearing 31 ($\omega_{carrier}$). That is, as shown in FIG. 2A, as balls B in the first one way bearing move toward the large curvatures of the grooves G, the carrier shaft 14 is held unable to rotate.

In the meantime, since the second one way bearing 32 is mounted such that a holding direction of the second one way bearing 32 is opposite to the holding direction of the first one way bearing 31, the driving shaft 15 is not held at the carrier shaft 14. That is, as shown in FIG. 2B, as balls B of the second one way bearing move toward the small curvatures of the grooves G, the driving shaft 15 is enabled to rotate.

Under this state, the planet gears 17 engaged with the sun gear 16 rotate in a direction (i.e., counter-clockwise direction) opposite to a rotation direction of the driving shaft ($\omega_{planet}$). In this instance, since the carrier shaft 14 is held at the bearing housing 11 by the first one way bearing 31, the planet gears 17 make no revolution around the sun gear 16.

Since the planet gears 17 have the internal gear 18 on the ring gear shaft 13 engaged therewith, the ring gear shaft 13 rotates in a direction (i.e., counter-clockwise direction) the same with a rotation direction of the planet gears 17 ($\omega_{ring}$). That is, as shown in FIGS. 6A and 6B, the rotation direction ($\omega_{input}$) of the motor 12 and the rotation direction ($\omega_{ring}$) of the ring gear shaft 13 are opposite.

A rotation speed of the ring gear shaft 13 is reduced according to gear ratios of the sun gear 16, and the planet gear 17, and the internal gear 18, and, according to this, a speed of the inner tub connected to an end of the ring gear shaft 13 is reduced, proportionally ($\omega_{input}>\omega_{ring}$).

Referring to FIGS. 7A and 7B, the operation of the driving unit will be described when the washing machine is operated in the spinning mode.

Upon application of power to the motor 12 following starting of the spinning cycle, as shown in FIG. 7A, as the rotor 12*b* rotates in the other direction (i.e., counter-clockwise direction), the driving shaft 15 rotates in the other direction (i.e., counter-clockwise direction) ($\omega_{input}$).

In this instance, the carrier shaft 14 is released from the bearing housing 11 by the first one way bearing 31. That is, as shown in FIG. 2B, as balls B of the first one way bearing move toward the small curvatures of the grooves G, the carrier shaft 14 is enabled to rotate ($\omega_{carrier}$).

At the same time with this, since the second one way bearing 32 is mounted such that the holding direction of the second one way bearing 32 is opposite to the holding direction of the first one way bearing 31, the second one way bearing holds the carrier shaft 14 and the driving shaft 15. That is, as shown in FIG. 2A, as balls B of the second one way bearing move toward the large curvatures of the grooves G, the carrier shaft 14 and the driving shaft 15 are held unable to rotate, relatively.

Because the sun gear 16 and the planet gears 17 make no relative rotation, the planet gears 17 do not rotate ($\omega_{planet}$). In this instance, the planet gears 17 only revolve around the sun gear 16 ($\omega_{carrier}$).

According to this, as shown in FIG. 7B, the ring gear shaft 13 rotates in the same speed, and in the same direction (i.e., counter-clockwise direction) with the driving shaft 15 ($\omega_{input}=\omega_{ring}$). As a result, in the spinning mode, the inner tub can be spun.

In the foregoing second embodiment, the rotation direction of the inner tub is always the same regardless of rotation direction of the rotor i.e., in a regular direction or a reverse direction, and when the rotor is rotated in one direction, the rotation speed of the inner tub is reduced by the reduction gear.

A third embodiment of a driving unit of the washing machine will be described with reference to FIGS. 8 to 10B. The third embodiment has the one directional holding means of which position is changed from the one directional holding means of the first embodiment. Therefore, only the feature of the third embodiment will be described, and the same reference symbols will be used for the same parts.

Figure 8:
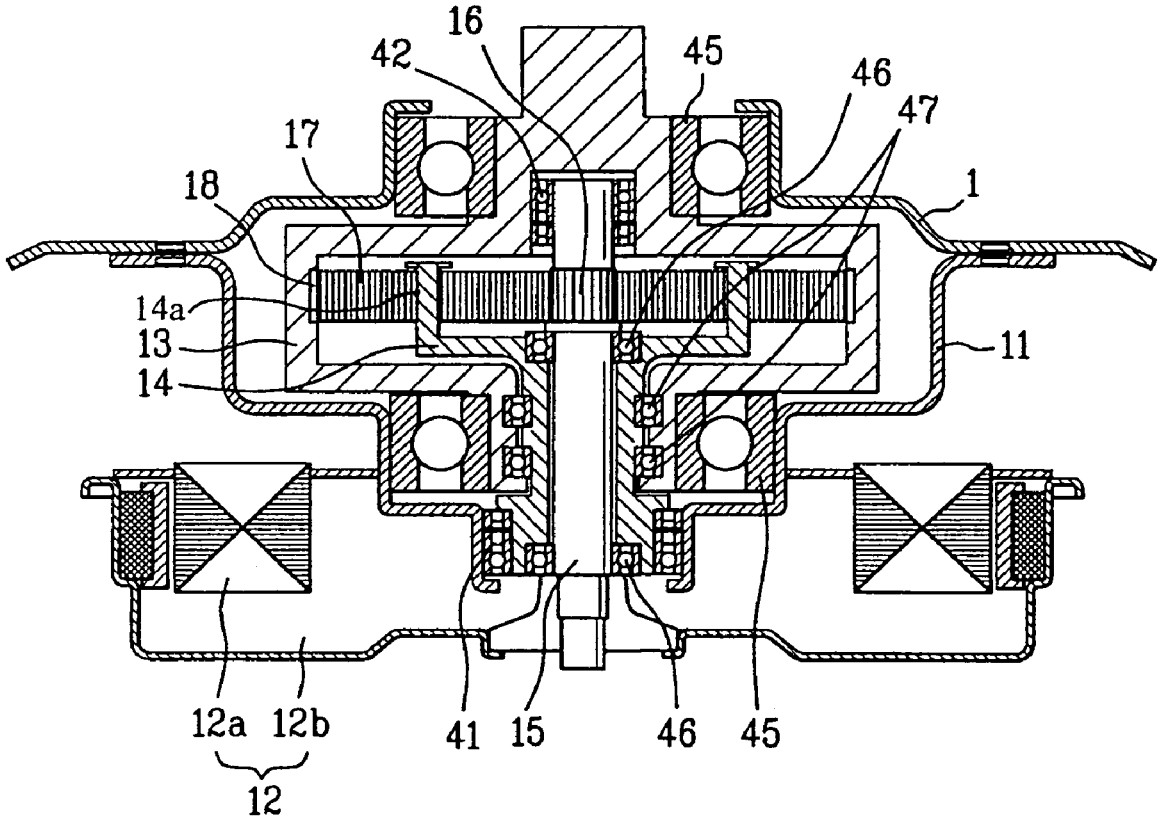
FIG. 8 illustrates a diagram of a third embodiment of the one directional holding device of the driving unit in FIG. 1.
Figure 9A:
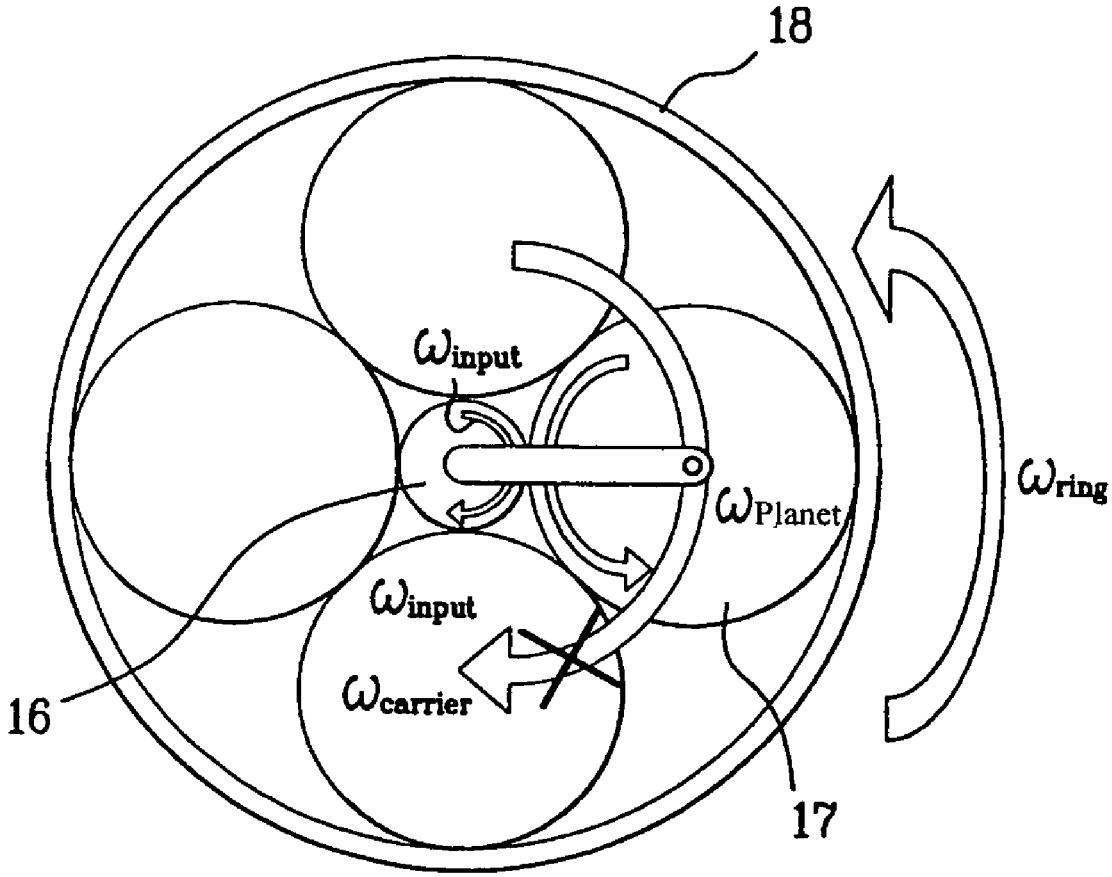
FIGS. 9A, and 9B illustrate diagrams of operation states of a driving unit when the washing machine of FIG. 8 is operated in a washing mode.
Figure 9B:
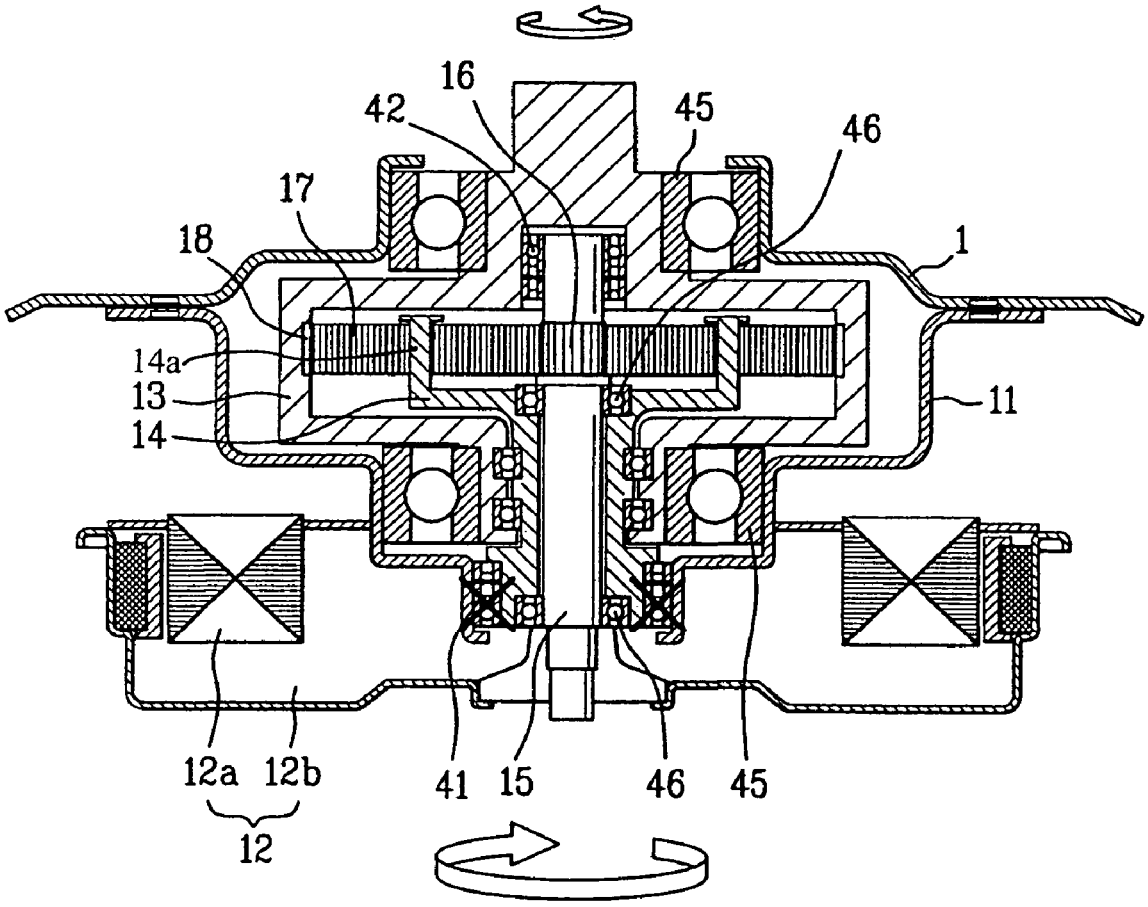
Figure 10A:
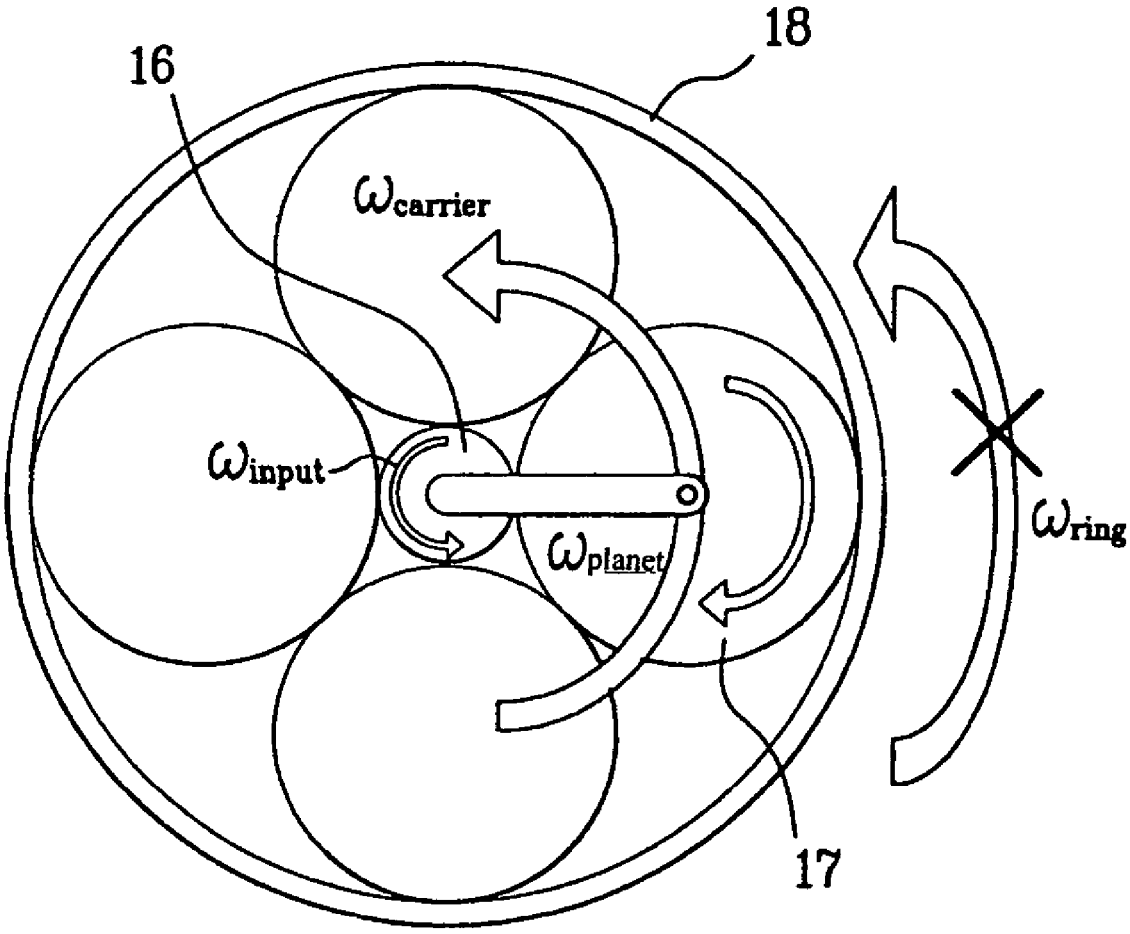
FIGS. 10A, and 10B illustrate diagrams of operation states of a driving unit when the washing machine of FIG. 5 is operated in a spinning mode.
Figure 10B:
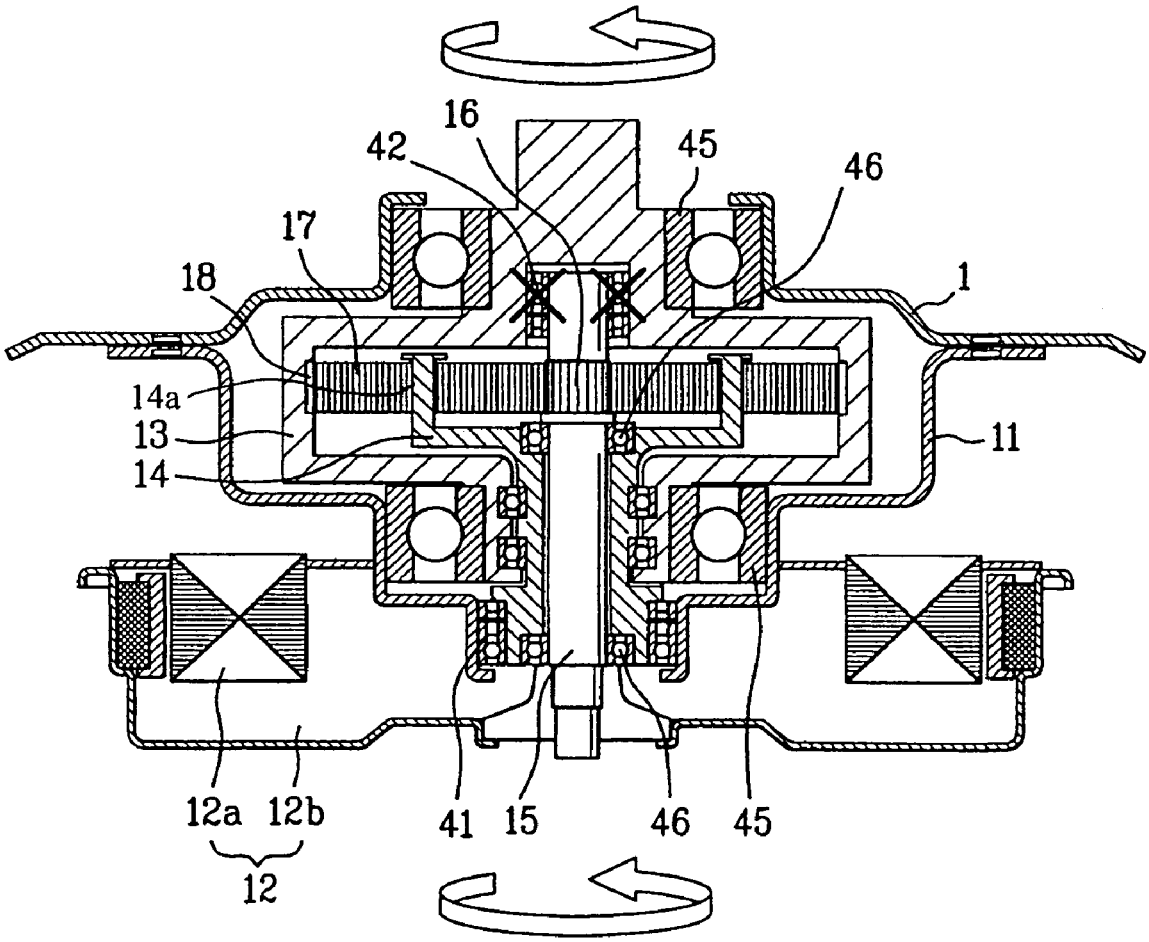

FIG. 8 illustrates a diagram of a second embodiment of the one directional holding device of the driving unit in FIG. 1. FIGS. 9A, and 9B illustrate diagrams of operation states of a driving unit when the washing machine of FIG. 5 is operated in a washing mode. FIGS. 10A, and 10B illustrate diagrams of operation states of a driving unit when the washing machine of FIG. 5 is operated in a spinning mode.

Referring to FIG. 8, the one directional holding device includes a first one way bearing 41 between the bearing housing 11 and the carrier shaft 14 for making the carrier shaft 14 to be held at the bearing housing 11 only when the driving shaft 15 is rotated in one direction, and a second one way bearing 42 between the ring gear shaft 13 and the driving shaft 15 for holding the ring gear shaft 13 and the driving shaft 15 only when the driving shaft 15 is rotated in the other direction.

The driving shaft 15 has an end portion placed in the ring gear shaft 13, and, between the end of the driving shaft 15 and the ring gear shaft 13, there is the second one way bearing 42.

On outside circumferential surfaces of the ring gear shaft 13, there are supporting bearings 45 mounted thereon for bidirectional rotation of the ring gear shaft 13. In addition to this, between the ring gear shaft 13, and the carrier shaft 14, and the driving shaft 15, there are supporting bearings 46 for supporting, and bidirectional rotation of, the ring gear shaft 13, and the carrier shaft 14.

The operation of the driving unit having the third embodiment of the one directional holding device applied thereto will be described. At first, referring to FIGS. 9A and 9B, the operation of the driving unit will be described when the washing machine is in a washing mode.

Referring to FIG. 9A, when power is applied to the motor 12 following starting of the washing cycle, the driving shaft 15 is rotated in one direction (i.e., a clockwise direction) ($\omega_{input}$), following rotation of the rotor 12*b* in one direction.

In this instance, the carrier shaft 14 is held at the bearing housing 11 by the first one way bearing 41 ($\omega_{carrier}$).

In the meantime, since the second one way bearing 42 is mounted such that a holding direction of the second one way bearing 42 is opposite to the holding direction of the first one way bearing 41, the driving shaft 15 is not held at the carrier shaft 14.

Under this state, the planet gears 17 engaged with the sun gear 16 rotate in a direction (i.e., counter-clockwise direction) opposite to a rotation direction of the driving shaft ($\omega_{planet}$). In this instance, since the carrier shaft 14 is held at the bearing housing 11 by the first one way bearing 41, the planet gears 17 make no revolution around the sun gear 16.

Since the planet gears 17 have the internal gear 18 on the ring gear shaft 13 engaged therewith, the ring gear shaft 13 rotates in a direction (i.e., counter-clockwise direction) the same with a rotation direction of the planet gears 17 ($\omega_{ring}$). That is, as shown in FIGS. 9A and 9B, the rotation direction ($\omega_{input}$) of the motor 12 and the rotation direction ($\omega_{ring}$) of the ring gear shaft 13 are opposite.

A rotation speed of the ring gear shaft 13 is reduced according to the gear ratio of the sun gear 16, the planet gear 17, and the internal gear 18, and, according to this, a speed of the inner tub connected to an end of the ring gear shaft 13 is reduced, proportionally ($\omega_{input}>\omega_{ring}$).

Referring to FIGS. 10A and 10B, the operation of the driving unit will be described when the washing machine is operated in the spinning mode.

Upon application of power to the motor 12 following starting of the spinning cycle, as shown in FIG. 10A, as the rotor 12*b* rotates in the other direction, the driving shaft 15 rotates in the other direction (i.e., counter-clockwise direction) ($\omega_{input}$).

In this instance, the carrier shaft 14 is released from the bearing housing 11 by the first one way bearing 41, and is rotated ($\omega_{carrier}$).

At the same time with this, since the second one way bearing 42 is mounted such that the holding direction of the second one way bearing 42 is opposite to the holding direction of the first one way bearing 41, the second one way bearing holds the ring gear shaft 13 and the driving shaft 15.

Because the sun gear 16 and the planet gears 17 make relative rotation, the planet gears 17 rotate ($\omega_{planet}$). Since the carrier shaft 14 is not held, the planet gears 17 revolve around the sun gear 16 in a clockwise direction ($\omega_{carrier}$). In this instance, since the driving shaft 15 and the ring gear shaft 13 are held by the second one way bearing 42, though the planet gears 17 rotate, as well as revolve, the planet gears can not serve as a reduction gears, actually.

According to this, as shown in FIG. 10B, the ring gear shaft 13 rotates in the same speed, and in the same direction (i.e., counter-clockwise direction) with the driving shaft 15 ($\omega_{input}=\omega_{ring}$). Thus, in the spinning mode, the inner tub can be spun.

In the foregoing second embodiment, the rotation direction of the inner tub is always the same regardless of the rotation direction of the rotor i.e., in a regular direction or a reverse direction, and when the rotor is rotated in one direction, the rotation speed of the inner tub is reduced by the reduction gear.

Figure 11:
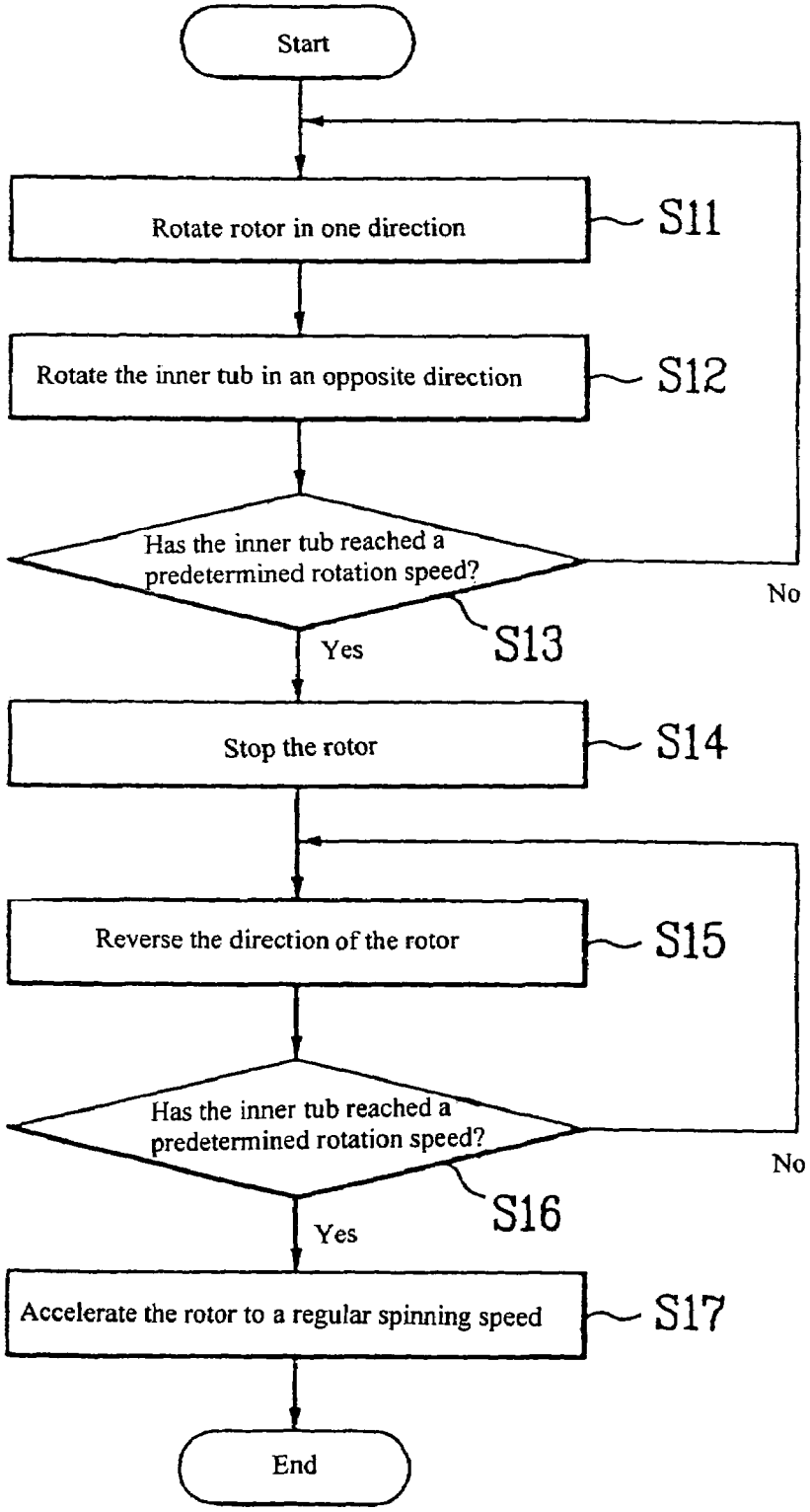
FIG. 11 illustrates a flow chart showing steps of a method for spinning a washing machine in accordance with the present invention.
Figure 12:
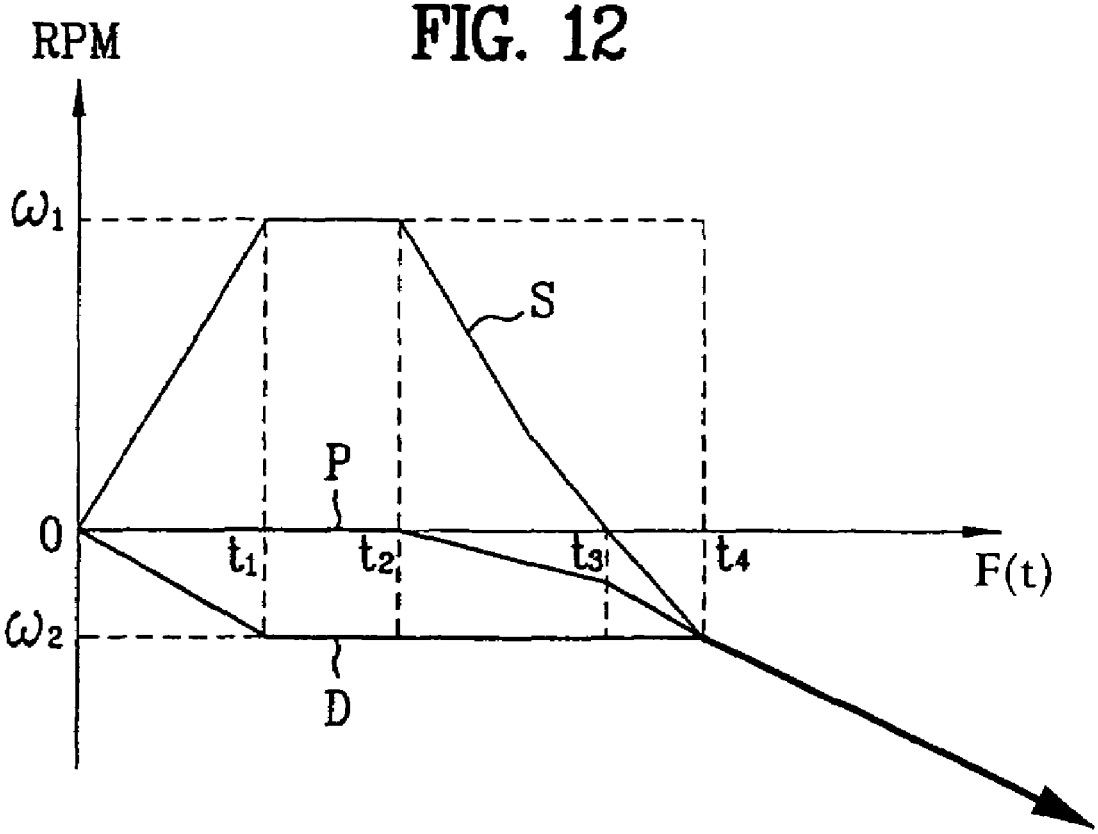
FIG. 12 illustrates a graph showing rotation speed of a rotor and an inner tub in the spinning in FIG. 11.

A method for controlling the foregoing washing machine will be described with reference to FIGS. 11 and 12. FIG. 11 illustrates a flow chart showing steps of a method for spinning a washing machine in accordance with the present invention, and FIG. 12 illustrates a graph showing rotation speed of a rotor and an inner tub in the spinning in FIG. 11.

Upon starting a washing cycle or rinsing cycle, the rotor is rotated in one direction to rotate the inner tub in a direction opposite to the rotor. According to this, laundry is washed or rinsed. Upon finishing such a washing, or rinsing cycle, washing water is drained, and a spinning cycle is performed.

Upon starting the spinning cycle of the washing machine, the rotor is rotated in one direction, to rotate the inner tub in a direction opposite to the rotor at a reduced speed (steps S11 and S12). That is, as shown in FIG. 12, a rotation speed (an S curve) of the rotor is higher than a rotation speed (a D curve) of the inner tub ($\omega_1 > \omega_2$).

Thus, as a speed of the inner tub is reduced by the reduction gear, a torque of the rotor increases, to rotate the inner tub easily.

In this instance, it is preferable that the inner tub is rotated at a speed such that the laundry can be distributed evenly ($\omega_2$ in FIG. 12). For example, the inner tub may be rotated at approximately 50~60 rpm.

It is required that the rotation speed of the inner tub is determined taking a capacity of the inner tub and an amount of the laundry into account. For example, as the capacity of the inner tub is increased, the greater the diameter of the inner tub, and a relatively high rotation speed is required for distributing the laundry evenly. Conversely, as the capacity of the inner tub is reduced, the diameter of the inner tub becomes smaller, and a relatively low rotation speed is adequate for distributing the laundry evenly. If the amount of laundry is great, a high rotation speed is required, and if the amount of laundry is small, a low rotation speed is required.

Thus, by distributing the laundry evenly at an initial stage of the washing cycle, shaking of the inner tub is prevented, resulting in reduced noise of impact that occurs as the outer tub and the inner tub collide.

When the inner tub reaches a predetermined rotation speed (S13), i.e., to a time point t2 in FIG. 12, the rotor is stopped (S14) and the rotor is reversed (S15). In this instance, the inner tub is rotated in a direction the same with a rotation direction of the inner tub at the time of speed reduction (S15). That is, the inner tub rotates in the same direction regardless of the rotation direction of the motor.

In this instance, it is preferable that the rotor is reversed (S15) after the rotor is stopped (S14) (t3 time point in FIG. 12).

The rotation of the inner tub at a high speed following the rotation of the inner tub at a low speed by rotating the rotor in a reverse direction following rotation of the rotor in one direction is referred to as "dynamic clutching".

The rotation of the inner tub with such a dynamic clutching, which increases the torque of the rotor, enables the spinning to start directly even with a small sized motor.

After the dynamic clutching, the rotor is accelerated to a regular spinning speed, to extract water from the laundry (S17).

In this instance, the inner tub is accelerated to a predetermined rotation speed (ω2 in FIG. 12), to make a preliminary spinning.

Even in the preliminary spinning, it is preferable that the inner tub is rotated at a speed at which a laundry can be distributed evenly. It is more preferable that the inner tub is accelerated to a speed at which the laundry can be distributed evenly through predetermined stages.

For an example, after accelerating the inner tub until the inner tub reaches approximately 50~60 rpm at first, the inner tub is accelerated until the inner tub reaches to a speed of approximately 80~200 rpm for the second time. Accelerating stages of the inner tub are divided the more as the accelerating stages become closer to approximately 200 rpm.

If the rotation speed of the inner tub reaches to the preliminary spinning stage (S16), the inner tub is accelerated to a regular spinning speed, to extract water from the laundry (S17).

Thus, after distributing the laundry evenly in the steps of decelerating the inner tub, and spinning preliminarily, the inner tub is rotated in a regular spinning speed, to extract water from the laundry.

As has been described, the washing machine, and the method for controlling the same of the present invention have the following advantages.

First, the rotation of the inner tub at a high speed/low speed by rotating the rotor of the driving unit of the washing machine in regular/reverse direction permits to dispense with an additional clutch. According to this, the driving unit can be simply structured, enabling a reduction in the cost of manufacture.

Second, the driving unit has reduced mechanical noise because no clutch or the like moves together with the driving unit, and reduced electric noise because no rotation speed control of the motor is required.

Third, the washing method permits to rotate the inner tub at an initial stage of spinning directly even with a small sized motor by reducing a rotating speed of the inner tub at the initial stage of the spinning to increase the torque of the rotor enough to rotate the inner tub at a high speed. According to this, the washing method permits to start the spinning, directly.

Fourth, the speed reduction of the inner tub at the initial spinning permits to shorten a time period required for starting a regular spinning. The distribution of laundry during reduced speed rotation of the inner tub dispenses with an additional step for distributing the laundry, thereby reducing a total spinning time period, and power consumption.

Fifth, the reduced speed rotation of the inner tub at the initial spinning, which makes a current to the motor uniform, permits to reduce electrical noise.

What is claimed is:

1. A driving unit for a washing machine, comprising:

a bearing housing fixedly secured to an outer tub of the washing machine;

a motor mounted on said bearing housing;

a ring gear shaft rotatably mounted to said bearing housing, said ring gear shaft being coupled to an inner tub of the washing machine;

a carrier shaft rotatably mounted to said ring gear shaft;

a driving shaft rotatably mounted to said carrier shaft, said driving shaft being coupled to said motor;

a reduction gear positioned between said ring gear shaft and said carrier shaft to reduce a rotation speed of said ring gear shaft; and a one directional holding device that holds said carrier shaft when said driving shaft rotates in a first direction, and holding two of said carrier shaft, said ring gear shaft, and said driving shaft holding said ring gear shaft and said carrier shaft when said driving shaft rotates in a second direction; and wherein said one directional holding device comprises:

a first one way bearing between said bearing housing and said carrier shaft that holds said carrier shaft to said bearing housing only when said driving shaft is rotated in the first direction; and a second one way bearing between said ring gear shaft and said carrier shaft that holds said ring gear shaft and said carrier shaft only when said driving shaft is rotated in the second direction.

2. The driving unit of claim 1, further comprising a supporting bearing mounted on an outside circumferential surface of said ring gear shaft to bidirectionally rotate said ring gear shaft, and a supporting bearing between said carrier shaft and said driving shaft that supports, and bidirectionally rotates said driving shaft.

3. A driving unit for a washing machine, comprising:

a bearing housing fixedly secured to an outer tub of the washing machine;

a motor mounted on said bearing housing;

a ring gear shaft rotatably mounted to said bearing housing, said ring gear shaft being coupled to an inner tub of the washing machine;

a carrier shaft rotatably mounted to said ring gear shaft;

a driving shaft rotatably mounted to said carrier shaft, said driving shaft being coupled to said motor;

a reduction gear positioned between said ring gear shaft and said carrier shaft to reduce a rotation speed of said ring gear shaft; and a one directional holding device that holds said carrier shaft when said driving shaft rotates in a first direction, and holding two of said carrier shaft, said ring gear shaft, and said driving shaft holding said ring gear shaft and said carrier shaft when said driving shaft rotates in a second direction; and wherein said one directional holding device comprises:

a first one way bearing between said bearing housing and said carrier shaft to hold said carrier shaft to said bearing housing only when said driving shaft is rotated in the first direction; and a second one way bearing between said carrier shaft and said driving shaft to hold said carrier shaft and said driving shaft only when said driving shaft is rotated in the second direction.

4. The driving unit of claim 3, further comprising a supporting bearing mounted on an outside circumferential surface of said ring gear shaft to bidirectionally rotate said ring gear shaft, and supporting bearings between said ring gear shaft, said carrier shaft, and said driving shaft that supports and bidirectionally rotates said carrier shaft.

5. A driving unit for a washing machine, comprising:

a bearing housing fixedly secured to an outer tub of the washing machine;

a motor mounted on said bearing housing;

a ring gear shaft rotatably mounted to said bearing housing, said ring gear shaft being coupled to an inner tub of the washing machine;

a carrier shaft rotatably mounted to said ring gear shaft;

a driving shaft rotatably mounted to said carrier shaft, said driving shaft being coupled to said motor;

a reduction gear positioned between said ring gear shaft and said carrier shaft to reduce a rotation speed of said ring gear shaft; and a one directional holding device that holds said carrier shaft when said driving shaft rotates in a first direction, and holding two of said carrier shaft, said ring gear shaft, and said driving shaft holding said ring gear shaft and said carrier shaft when said driving shaft rotates in a second direction; and wherein said one directional holding device comprises:

a first one way bearing between said bearing housing and said carrier shaft that holds said carrier shaft to said bearing housing only when said driving shaft is rotated in the first direction; and a second one way bearing between said ring gear shaft and said driving shaft to hold said ring gear shaft and said driving shaft only when said driving shaft is rotated in the second direction.

6. The driving unit of claim 5, wherein said driving shaft has an end portion placed in said ring gear shaft, and said second one way bearing is mounted between said end portion and said ring gear shaft.

7. The driving unit of claim 5, further comprising a supporting bearing mounted on an outside circumferential surface of said ring gear shaft to bidirectionally rotate said ring gear shaft, and supporting bearings between said ring gear shaft, said carrier shaft, and said driving shaft to support and bidirectionally rotate said ring gear shaft, said carrier shaft, and said driving shaft, respectively.

* * * * *